United States Patent [19]

Haberstumpf

[11] Patent Number: 4,479,415

[45] Date of Patent: Oct. 30, 1984

[54] TRACKER ACTION TOUCH FOR KEYS IN A KEYBOARD MUSICAL INSTRUMENT

[75] Inventor: Harold E. Haberstumpf, Emmaus, Pa.

[73] Assignee: Allen Organ Company, Macungie, Pa.

[21] Appl. No.: 456,061

[22] Filed: Jan. 6, 1983

[51] Int. Cl.³ ..... G10C 3/12

[52] U.S. Cl. ..... 84/439; 84/423 R; 84/433; 84/440

[58] Field of Search ..... 84/433, 423, 439, 440; 200/1 A, 5 R, 6 B, 6 BA, 6 BB, 6 C, 283

[56] References Cited

U.S. PATENT DOCUMENTS 3,903,780 9/1975 Aliprandi ..... 84/433

*Primary Examiner*—Michael L. Gellner
*Assistant Examiner*—Douglas S. Lee
*Attorney, Agent, or Firm*—Sanford J. Piltch

[57] ABSTRACT

A key action for an electronic musical instrument for simulating a mechanical-type tracker action having a single means embodying an electrical contact means and a motion retarding means to cause a toggling of the key while the electrical contact is maintained.

1 Claim, 2 Drawing Figures

TRACKER ACTION TOUCH FOR KEYS IN A KEYBOARD MUSICAL INSTRUMENT

BACKGROUND OF THE INVENTION

This invention resides broadly in the field of keyboard musical instruments and is particularly adaptable for use in electronic or pipe organs as a system for producing what is commonly known as "tracker touch" for the keys.

In a mechanical action pipe organ, which is sometimes known as a tracker action, the "feel" of the keys is characterized by an initial resistance as the key is depressed. As the key is depressed farther downward, it "drops" or "toggles" so that as the key travels through its complete distance and just before it rests on the key bed noticeable reduction in the pressure or force needed to depress the key is apparent to the player. This results in a feel which is prized by many keyboard musicians and organists.

The function of a key in a keyboard musical instrument, e.g., an organ, is to allow the musician to effectively control, by a playing technique, the duration of the tones that are developed by the keyboard musical instrument. This will be true whether the instrument is an organ using traditional pipes or an electronic musical instrument simulating the sound of a pipe organ. Generally speaking, in keyboard musical instruments, such as organs, which do not have mechanical actions with an inherent tracker touch, a tension spring is supplied to return the key to its normal position. Tracker touch arrangements have been devised for such instruments to replace this simple spring arrangement. Some of these arrangements have included the use of magnets. Others have utilized torsion springs of various sorts which are mounted in offset positions so that as the key is depressed, a toggling effect is produced.

Some examples of those torsion springs which have been used are described immediately following. In a Casavant pipe organ a "grasshopper" spring was used to achieve the desired toggling effect. The grasshopper spring was mounted to a brass pin in a slot on the key tail and secured by a hook arrangement on the end of one leg of the spring. The other leg of the spring is bent outward toward its end and is positioned in a "dent" in a horizontal metal bar mounted along the rear edge of the key bed. The position of the dent in the bar was such that it allowed the spring to move or "toggle" without physically stroking the bar as the key was depressed.

Another method for achieving the tracker action was what may be called the Holtkamp system. A pointed metal stamping was held by a pin in a slot in the key tail at an upward angle. The distal end of the metal stamping, when the key was in its normal position, rested in a dent or depression in a spring fastened to the key bed, extending vertically upward therefrom. As the key was depressed, the metal stamping bent slightly as it was retained within the depression on the spring until the spring force was exceeded and the pin moved upward away from the depression, thus achieving the desired toggling effect.

Another method of achieving the tracker action "feel" was that put forth by Aeolian-Skinner. Towards the front of the key a spring made of a phosphor-bronze alloy was held in a fixed position on the underside of the key by an adjustable screw. This spring had a bend in its distal end with a depression in the bent portion. A grasshopper spring was held in a slot of the front pin rail in a fixed position while its other end was aligned with the depression in the phosphor-bronze spring when the key was in its normal position. As the key was depressed, the two springs would interact until their spring forces were exceeded and the grasshopper spring would toggle, thus reducing the necessary downward force on the key and achieving the desired tracker touch.

Another method was devised by E. M. Skinner. This was done by attaching a curved steel spring to the underside of the front pin rail, permitting the curved portion of the spring to extend upwards. The distal end of the curved steel spring included a depression for accommodating one end of a steel pin. Near the front end of the key and in close proximity to the curved spring an adjustable pin is located extending downward from the underside of the key. The pin had several detents or depressions located around its circumference at different distances from the underside of the key. This is so that the necessary force to achieve the toggling effect may be adjusted to be greater or lesser at the option of the player. Extending between the downward extending pin and the curved spring is a steel pin having points at both of its ends to fit into the depression of the spring and the detent in the pin. The steel pin is held in place by the spring force from the spring. With the key in the normal position the steel pin is inclined slightly upward towards the downward extending pin and, as the key is depressed, the pin travels downward causing the pin to achieve a horizontal position. At or near this horizontal position the toggling effect is achieved due to the downward force exceeding the spring force. The spring then adds to the downward pressure on the key as the detent in the downward extending pin is forced below the level of the depression in the curved spring so that the steel pin is now inclined downward to the rear of the key bed. This interaction applies additional force to the depressing of the key. Upon key release the spring components return to their normal position with the steel pin being inclined slightly upward towards the rear of the key bed. It should be noted that the steel pin remains in the depression of the curved spring and in the selected detent of the downwardly extending pin at all times.

The problems with the above-described spring arrangements are that they invariably get out of adjustment as they are used over a period of time. This is caused by the wearing of the mechanical parts and due to such wear the change in the spring factor resulting in a change, i.e., a decrease, in the spring force which achieves the desired "toggling" of the tracker touch. Thus the feel which is so prized by the keyboard musician is lost completely or distorted which makes this playing technique unmanageable.

It is an object of this invention to eliminate the necessity of the complicated mechanical interaction of the spring mechanisms of the prior attempts to achieve the desired effect and to substitute therefor a simple mechanism not subject to the constant wear and adjustment necessitated by the prior mechanisms.

Other objects will appear hereinafter.

SUMMARY OF THE INVENTION

The present invention combines the function of an electrical contact in an extremely simple mechanical arrangement to produce the desired tracker touch. The tracker touch or feel is accomplished by forming one portion of the electrical contact mechanism in such manner to provide the particular feel.

One advantage of this invention is the combination of an electrical contact and a tracker mechanism in one simple mechanism which requires a minimum of adjustment during a lifetime of use.

An additional advantage is that the feel of the keys can be predictably controlled merely by designing the shape of the protrusion or bend in the electrical contact blade.

Further advantage of the invention is that it is extremely low in cost and, in fact, may be considered almost "no cost" in that it requires no additional components to produce the tracker touch as differentiated from earlier systems where individual mechanisms for producing such tracker touch were separate and apart from the electrical contacts which were associated with each of the keys.

The present invention simulates a mechanical-type tracker action in a key action of an electronic musical instrument. The invention includes a key supported above a key bed by a pivot pin and also has a guide pin for limiting horizontal movement of the key but allowing vertical movement thereof. The key action also includes a return spring fastened between a key tension adjusting means mounted to the key and said key bed and a key return limiting means for returning the key, upon release thereof, to its normal or rest position. The improvement to the above described conventional key action comprises a key switch means located at the distal end of the key. The key switch means had first and second contact means for establishing an electrical contact on the depression of the key. The key contact means are mounted in a spaced-apart relation but in close proximity to each other and mounted with said first contact means in touching relation to the distal end of the key. The first contact means has a forward facing protrusion for retarding the vertical movement of the key until sufficient pressure has been exerted on the key to cause a toggling of the key as the retarding force of the first contact means is overcome while the electrical contact is maintained. Thus, the key switch means provides both an electrical contact and a tracker action in a single means.

BRIEF DESCRIPTION OF THE DRAWINGS

For the purposes of illustrating the invention, there are shown in the drawings forms which are presently preferred, it being understood, however, that the invention is not limited to the precise arrangements and instrumentalities shown.

DETAILED DESCRIPTION OF THE PREFERRED EMBODIMENTS OF THE INVENTION

The following detailed description is of the best presently contemplated modes of carrying out the present invention. This description is not intended in a limiting sense, but is made solely for the purpose of illustrating the general principles of the invention.

Figure 1:
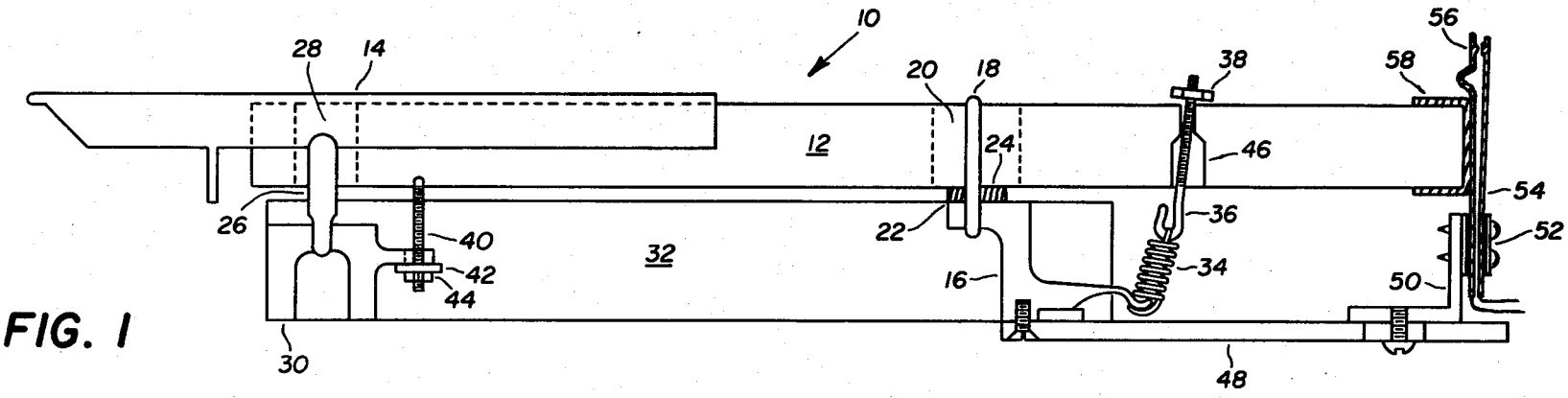
FIG. 1 is a side view of a section of the key bed of a musical instrument showing a single key action of one embodiment of the present invention.

Referring now to the drawings in detail wherein like numerals indicate like elements there is shown in FIG. 1 a key action 10 which is designed to be part of the keyboard for a keyboard musical instrument. In fact, the key action 10 will be replicated for each key of the keyboard whether it has 37, 44 or 61 keys. The key action 10 is comprised of a key 12 having a key cover 14 affixed to its playing surface. The key cover is usually of a plastic-type material of either a white or black color. The key cover 14 may be affixed to the upper front surface of the key 12 in any manner available to one skilled in the art, such as by the use of screws, contact cement, etc.

The key 12 is supported by a bracket 16 and guide pin 18. The guide pin 18 extends through a slot 20 in key 12 so as to permit rotational movement of the key about two sound deadening means 22, 24 which are usually felt strips on which the key 12 rests. The slot 20 has an elongated shape along the length of the key 12 allowing rotational movement of the key about guide pin 18 without any interference in such movement by having the pin 18 strike any of the walls of the slot 20. The pin 18 fits snuggly between the side walls of the slot 20.

The key 12 is permitted to move only in the vertical directions and is held rigid in the horizontal plane by guide pin 26 which restricts any horizontal motion of the key 12 while permitting vertical motion as key 12 rides up and down on the guide pin 26 through slot 28. Slot 28 is similar to slot 20 in shape and holds pin 26 snuggly within its walls. Guide pin 26 is securely fastened either by press-fit or other suitable means to bracket 30 which comprises a portion of the key bed. Bracket 30, at its ends, is securely fastened to key bed mounting bracket 32 which holds the entire key bed securely to the instrument case. Additionally bracket 16 is also securely fastened, at its ends, to the key bed mounting bracket 32 in a manner similar to the fastening of bracket 30 to mounting bracket 32.

Without a tension spring means to return the key to its normal position, the key 12, upon depression thereof, would remain depressed until lifted by the player. Extending rearward from bracket 16 is a curved protrusion which extends outward and downward forming a retaining means for holding one end of coil spring 34. The other end of spring 34 is connected to the hooked end of a means 36 for adjusting the tension or spring force to return the key to its normal position. The return spring force or tension is adjusted by the nut 38 being rotated about the threads of means 36 to increase or decrease the tension on the key 12.

The spring 34 in combination with the tension adjusting means 36 would cause the key 12 to return beyond its normal position if it were not for the key return limiter 40. The key return limiter 40 is embedded in the underside of key 12 by any desired manner and causes the limiting of the key return by striking a rearward protrusion of bracket 30. This protrusion limits the upward travel of the limiter 40 causing the key 12 to cease its movement at its initial position. The limiter 40 includes a felt cushion 42 to prevent unwanted noise and an adjusting nut 44 to fix the position of the key 12 in conjunction with the tension means 36.

So as not to interfere with the operation, depression and release, of the key 12 the tension means 36 is provided with a slot 46 which is wider at the bottom and tapers towards the top to allow the key 12 to be operated normally without interference from the tension means 36.

The bracket 16 has connected to it by means of a screw or other fastening means support member 48 which in turn supports an L-shaped bracket 50 which supports the electrical contact switch of the key action. Having just described the conventional configuration of an instrument key action, I will now describe my invention.

The present invention provides the keyboard musical instrument player with a tracker touch feel as the player plays the keys by the following interrelationship or interaction between the key and the key contact switch. The key contact switch 52 is attached to bracket 50 and has one of its contact strips in touching relationship to the rearwardmost portion or tail of the key 12. The key contact switch 52 has two contact means 54, 56 which, when closed, indicate the depression of the key. The forwardmost key contact 56 is displaced slightly from the tail of the key 12 by a sound suppression material, usually felt, which is also non-conductive. This felt piece 58 is attached to the key 12 by means of cementing, gluing or any other means known to those skilled in the art. The felt piece 58 also serves to cushion the mechanical interaction between the key 12 and the contact means 56 to provide less wear over the lifetime of the key action.

The key switch operates in the following manner. As the key is depressed, the felt cushion 58 is lifted by the key 12 to come into contact with the forward facing protrusion on the contact means 56 forcing the contact means 56 into electrical contact with contact means 54. Contact means 54, 56 are normally separated by insulating materials which keep the two contact means apart from each other until actuated. Each of the contact means 54, 56 is electrically connected to the musical instrument by means of attaching wires to their lowermost portions by soldering or in whatever other manner one skilled in the art desires.

As the key 12 is depressed farther, its rearmost portion and the felt cushion means 58 are lifted higher exerting increased pressure on the protrusion of contact means 56 forcing it back farther until the key 12 finally moves past such protrusion and achieves the toggling effect so desired by keyboard musicians. In this fashion the forward facing protrusion of the first contact means retards the vertical movement of the key until sufficient pressure has been exerted on the key to cause the toggling of the key as the retarding force of the first contact means is overcome. During and after the toggling the electrical contact is maintained. While this process is ongoing the spring 34 and tension means 36 are being extended until such time as the player releases the key and the aforementioned means returns the key to its normal position with the key return limiter 40 causing the key to stop in an approximately horizontal position. As the key returns to its normal position, contact means 54 and 56 which had been previously pushed backward away from the rearmost portion of the key 12 return to their normal spaced-apart positions. It should be noted that the contact means 54, 56 of the key contact switch 52 are made of resilient material which has a certain springiness to it and which material is also electrically conductive.

Figure 2:
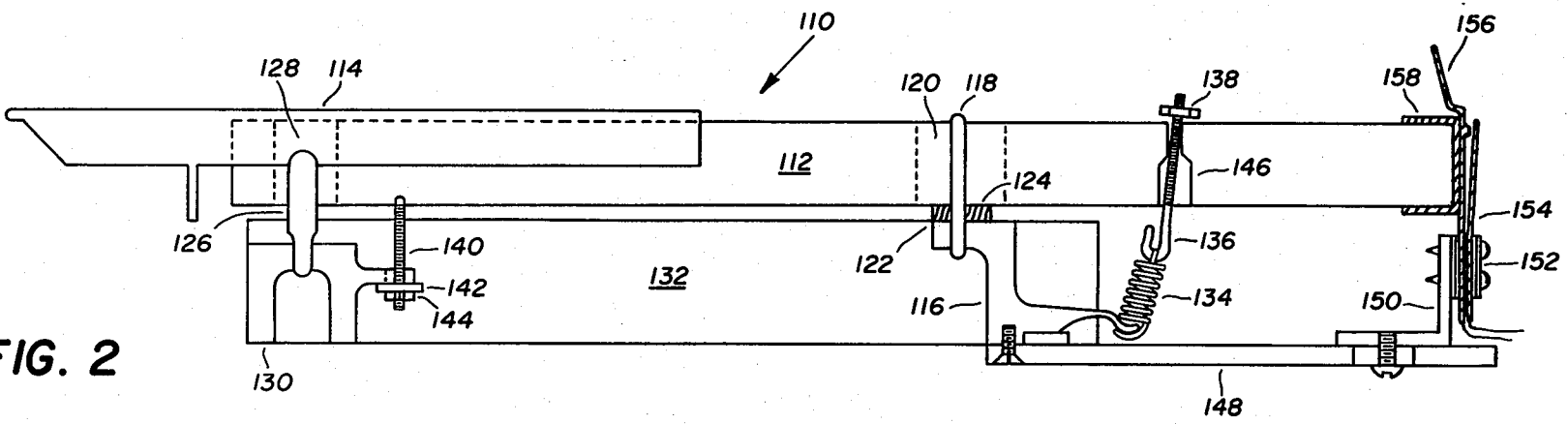
FIG. 2 is a side view of a section of the key bed of a musical instrument showing a single key action of a second embodiment of the present invention.

The foregoing description applies in its entirety to the second embodiment of the present invention as shown in FIG. 2. Corresponding figure numbers will apply to the identical elements, i.e. 10=110; with the exception that the contact means 156 of key contact switch 152 has a different physical configuration. Instead of the forward facing rounded protrusion of contact means 56, the contact means 156 has a first forward facing bend so that that portion of the contact means 156 is substantially parallel to the key 112 in its initial position. A second bend in contact means 156 results in the remaining portion of the contact means being inclined upwardly and having an acute angle in relation to the vertical. The key 112, when depressed, causes the rearmost portion of the key 112 and the felt cushion 158 to rise due to such depression causing pressure on the first bend of the contact means 156. This pressure in turn causes the contact means 156 to form an electrical connection with contact means 154 by wiring rearward. Continued downward pressure on the key cover 114 of the key 112 causes the key 112 to continue to rise and snap or toggle past the second bend in the contact means 156 causing the desired tracker touch feel. In this fashion the forward facing protrusion of the first contact means retards the vertical movement of the key until sufficient pressure has been exerted on the key to cause the toggling of the key as the retarding force of the first contact means is overcome. The electrical contact is similarly maintained in this embodiment. On release, the key 112 responds in the identical fashion to that stated in the foregoing description with the key contact 152 separating and returning to its normal position as the key falls below the bends of the contact means 156.

Thus, the combination of the use of the key contact switch to electrically connect the key circuit upon the depression of the key and to achieve the desired toggling effect for the tracker touch feel is accomplished with the above-described invention without the necessity for additional spring mechanisms or arrangements. In addition, the present invention, in both embodiments thereof, does not require the constant attention, i.e. adjustments, as did the former mechanisms.

The present invention may be embodied in other specific forms without departing from the spirit or essential attributes thereof and, accordingly, reference should be made to the appended claims rather than to the specification as indicating the scope of the invention.

I claim:

1. A key action for an electronic musical instrument for simulating a mechanical-type tracker action including a key supported above a key bed by a pivot pin having a guide pin for limiting horizontal movement of the key but allowing vertical movement thereof; a return spring fastened between a key tension adjusting means mounted to the key and said key bed; and a key return limiting means for returning the key, upon release thereof, to its normal or rest position, the improvement comprising: a key switch means located at the distal end of the key having first and second contact means for establishing an electrical contact on the depression of the key mounted in a spaced-apart relation but in close proximity to each other and mounted with said first contact means in touching relation to the distal end of the key, said first contact means having a forward facing protrusion for retarding the vertical movement of the key until sufficient pressure has been exerted on the key to cause a toggling of the key as the retarding force of the first contact means is overcome while said electrical contact is maintained; whereby the key switch means provides both an electrical contact and a tracker action in a single means.

* * * * *